US007513485B2

(12) United States Patent
Lee

(10) Patent No.: US 7,513,485 B2
(45) Date of Patent: Apr. 7, 2009

(54) AUTOMATIC WINDER

(75) Inventor: Peter Yun-Hsin Lee, Taoyuan Hsien (TW)

(73) Assignee: Grand Winches Industry Co., Ltd. (TW)

( * ) Notice: Subject to any disclaimer, the term of this patent is extended or adjusted under 35 U.S.C. 154(b) by 255 days.

(21) Appl. No.: 11/655,017

(22) Filed: Jan. 18, 2007

(65) Prior Publication Data

US 2008/0173850 A1 Jul. 24, 2008

(51) Int. Cl.
*B66D 1/14* (2006.01)

(52) U.S. Cl. ..... 254/346; 254/342; 254/350; 254/351

(58) Field of Classification Search ..... 254/342, 254/346, 345, 350, 351, 368
See application file for complete search history.

(56) References Cited

U.S. PATENT DOCUMENTS 3,687,249 A * 8/1972 Priest et al. ..... 192/215
4,004,780 A * 1/1977 Kuzarov ..... 254/345
4,588,167 A * 5/1986 Finzel ..... 254/346
4,809,633 A * 3/1989 Santos ..... 114/210
RE33,898 E * 4/1992 Santos ..... 114/210
5,398,911 A * 3/1995 Holster ..... 254/267
7,017,887 B1 * 3/2006 Verakis ..... 254/342
7,140,598 B2 * 11/2006 Verakis et al. ..... 254/345
2006/0108571 A1 * 5/2006 Verakis et al. ..... 254/342

* cited by examiner

*Primary Examiner*—Emmanuel M Marcelo
(74) *Attorney, Agent, or Firm*—Jackson Walker, LLP

(57) ABSTRACT

An automatic winder has a base, motor, a transmission device and a reel. The motor is mounted on the base. The transmission device connects to the motor and has a pair of high-speed gears and a pair of low-speed gears. The reel is mounted on the transmission device and has a spool of a cord. When the motor is overloaded, the motor connects to the pair of the low-speed gears to drive the reel to prevent the break of the motor.

4 Claims, 5 Drawing Sheets

AUTOMATIC WINDER

BACKGROUND OF THE INVENTION

1. Field of the Invention

The present invention relates to a winder, and more particularly to an automatic winder that has a motor and a reel connected to the motor and having a spool of a cord. A rotational speed of the reel decreases automatically when a load on a distal end of the cord is too heavy to the motor so that the motor will not be overloaded and broken.

2. Description of Related Art

Winders are generally used to move heavy items. For example, a winder may be used in a ship to extend or retract an anchor.

Conventional winders may be hand-driven or motor-driven. A conventional hand-driven winder has a base, a reel and a crank. The reel is mounted rotatably on the base and has two ends, an axle and a spool of cord. The crank is mounted on one end along the axle of the reel and may be held and driven manually to rotate the reel to extend or retract the cord.

However, when an article on the cord is too heavy and the motor is probably overloaded and damaged.

To overcome the shortcomings, the present invention provides an automatic winder to mitigate or obviate the aforementioned problems.

SUMMARY OF THE INVENTION

The main objective of the invention is to provide an automatic winder that has a motor and a reel connected to the motor and having a spool of a cord. A rotational speed of the reel decreases automatically when a load on a distal end of the cord is too heavy to the motor so that the motor will not be overloaded and break.

An automatic winder has a base, motor, a transmission device and a reel. The motor is mounted on the base. The transmission device connects to the motor and has a pair of high-speed gears and a pair of low-speed gears. The reel is mounted on the transmission device and has a spool of a cord.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
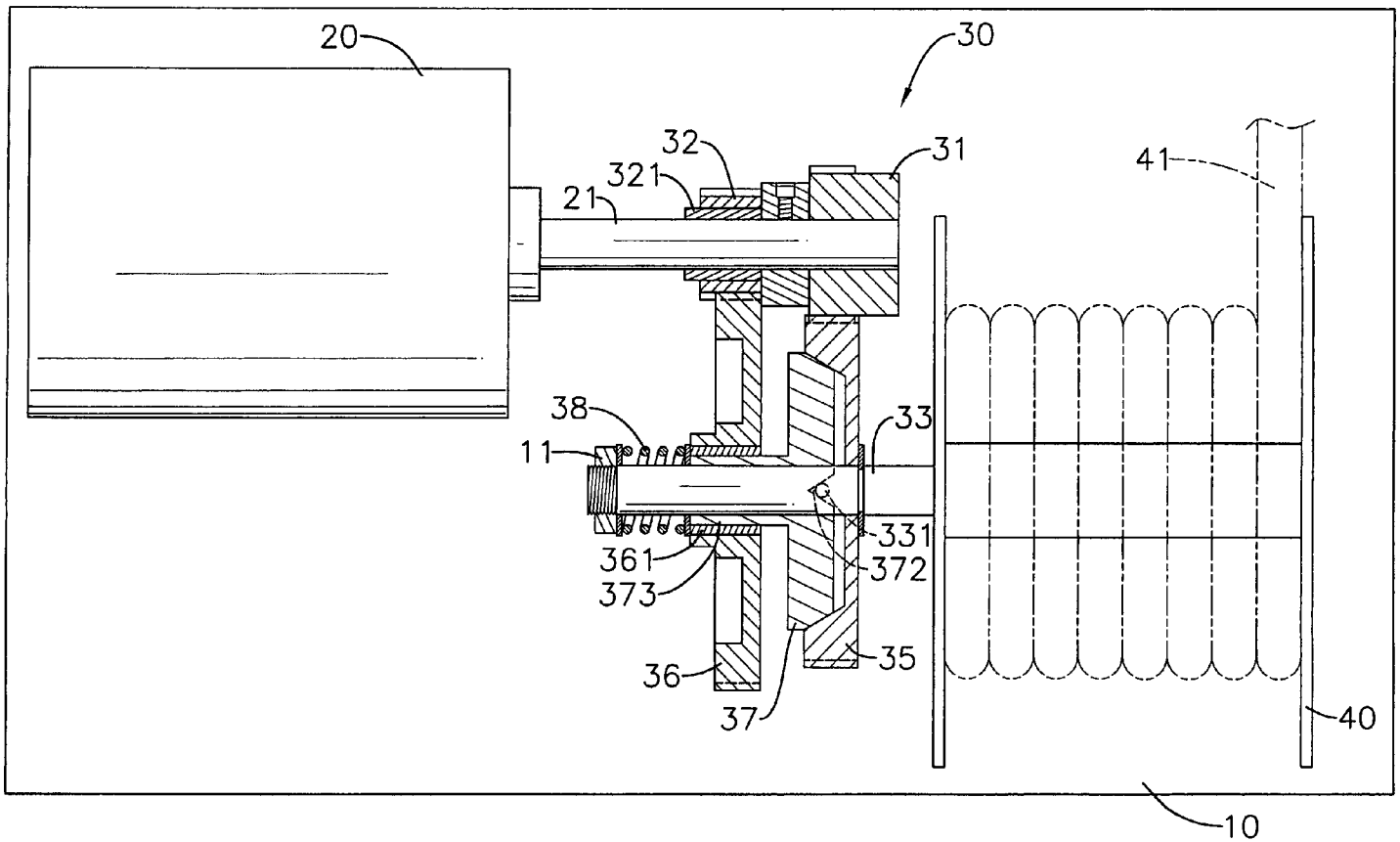
FIG. 1 is a top view in partial section of a first embodiment of an automatic winder in accordance with the present invention.
Figure 2:
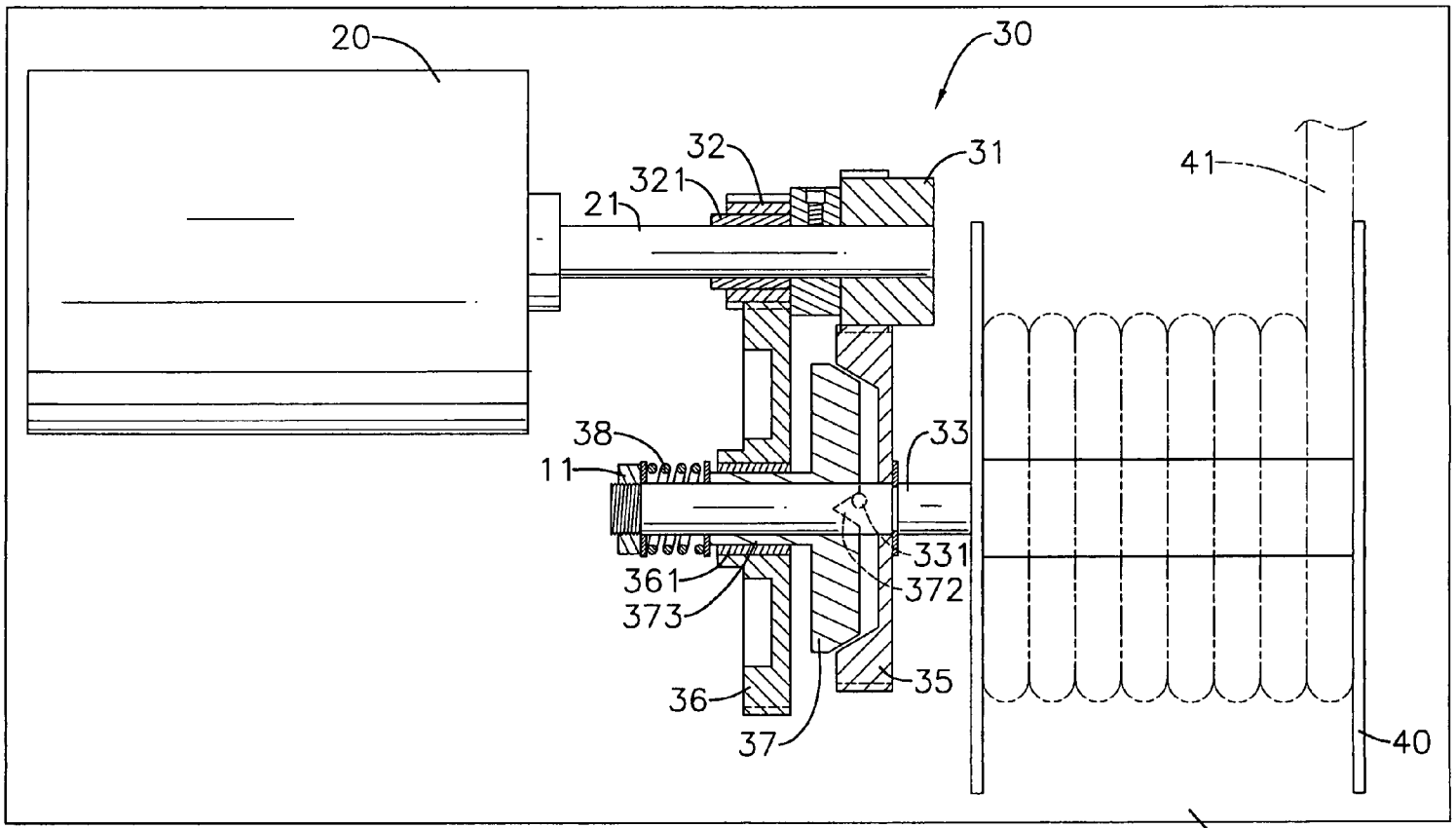
FIG. 2 is an operational top view in partial section of the automatic winder in FIG. 1.

With reference to FIGS. 1 and 2, a first embodiment of an automatic winder in accordance with the present invention comprises a base (10), a motor (20), a transmission device and a reel (40).

The base (10) has a support (11) mounted on and extending upward from the base (10).

The motor (20) is mounted to the base (10) and has a front end, a rear end and a motor shaft (21). The motor shaft (21) is mounted rotatably on the front of the motor (20).

The transmission device connects to the motor (20) and has a high-speed driving gear (31), a low-speed driving gear (32), a transmission shaft (33), a high-speed driven gear (35), a clutch (37), a low-speed driven gear (36) and a spring (38).

The high-speed driving gear (31) is mounted securely around the motor shaft (21) on the motor (20).

The low-speed driving gear (32) is mounted around the motor shaft (21) and is capable of rotating in a single rotational direction around the motor shaft (21), such as a clockwise rotational direction or a counterclockwise rotational direction. The low-speed driving gear (32) has a central hole and a first one-way restrictor (321). The central hole is defined through the low-speed driving gear and allows the motor shaft (21) to extend through the central hole. The first one-way restrictor (321) may be a one-way bearing, is mounted in the central hole, is mounted around the motor shaft (21) and keeps the low-speed driving gear (32) to rotate in the single rotational direction.

The transmission shaft (33) is mounted rotatably through the support (11) on the base (10), is parallel to the motor shaft (21) and has a pin (331). The pin (331) is mounted on and extends radially out from the transmission shaft (33).

The high-speed driven gear (35) is mounted rotatably around the transmission shaft (33), engages with the high-speed driving gear (31) and has a rear end.

The clutch (37) is mounted slidably around the transmission shaft (33) and selectively engages with or disengages from the high-speed driven gear (35). The clutch (37) has a front end, a rear end, an outer edge, a central hole, a notch (372) and a sleeve (373). The front end of the clutch (37) selectively abuts the rear end of the high-speed driven gear (35) tightly. The central hole is defined through the clutch (37) and allows the transmission shaft (33) to extend through the central hole. The notch (372) is V-shaped, is defined in the front end of the clutch (37), communicates with the central hole and selectively engages completely or halfway with the pin (331) on the transmission shaft (33) and always rotates with the transmission shaft (33). When the notch (372) in the clutch (37) engages completely with the pin (331) on the shaft, the front end of the clutch (37) tightly abuts the rear end of the high-speed driven gear (35) to provide a friction between the front end of the clutch (37) and the rear end of the high-speed driven gear (35). With the friction, the clutch (37), high-speed driven gear (35) and the transmission shaft (33) rotate synchronously. When the notch (372) engages halfway with the pin (331), the front end of the clutch (37) separates from the rear end of the high-speed driven gear (35) so that the high-speed driven gear (35) idles. The sleeve (373) is formed on and extends backward from the rear end of the clutch (37) and is mounted around the transmission shaft (33).

The low-speed driven gear (36) is mounted around the sleeve (373) on the clutch (37), is capable of rotating in a single rotational direction around the sleeve (373) and has an outer edge, a central hole and a second one-way restrictor (361). The central hole is defined through the low-speed driven gear (36) and allows the sleeve (373) to extend through the central hole. The second one-way restrictor (361) may be a one-way bearing, is mounted in the central hole in the low-speed driven gear (36), is mounted around the sleeve (373) and keeps the low-speed driven gear (36) to rotate in the single rotational direction. Furthermore, a ratio of a rotational speed of the high-speed driven gear (35) and a rotational speed of the high-speed driving gear (31) is larger than a ratio of a rotational speed of the low-speed driven gear (36) and a rotational speed of the low-speed driving gear (32).

The spring (38) is mounted around the transmission shaft (33), is located between, presses against the support (11) and the sleeve (373) on the clutch (37) and biases the front end of the clutch (37) to tightly abut the rear end of the high-speed driven gear (35).

The reel (40) is mounted securely around the transmission shaft (33), is driven by the motor (20) to rotate and has a spool of a cord (41). The cord (41) has a distal end to be attached to an article such as an anchor.

When a weight of the article is under a maximum load of the motor (20), the clutch (37) engages with the high-speed driven gear (35) and the motor (20) drives the reel (40) through the high-speed driving gear (31) and the high-speed driven gear (35).

When the article on the cord (41) is too heavy to overload the motor (20), the motor (20) drives the clutch (37) to slightly rotate relative to the transmission shaft (33). The pin on the transmission shaft (331) slides slightly out of and engages halfway with the notch (372) in the clutch (37) due to a minor relative rotation of the clutch (37) and the transmission shaft (33). The front end of the clutch (37) moves backward, disengages from the high-speed driven gear (35) and causes the high-speed driven gear (35) to idle. At this time, the motor (20) drives the reel (40) through the low-speed driving gear (32) and the low-speed driven gear (36) so the motor (20) is not overloaded.

Figure 3:
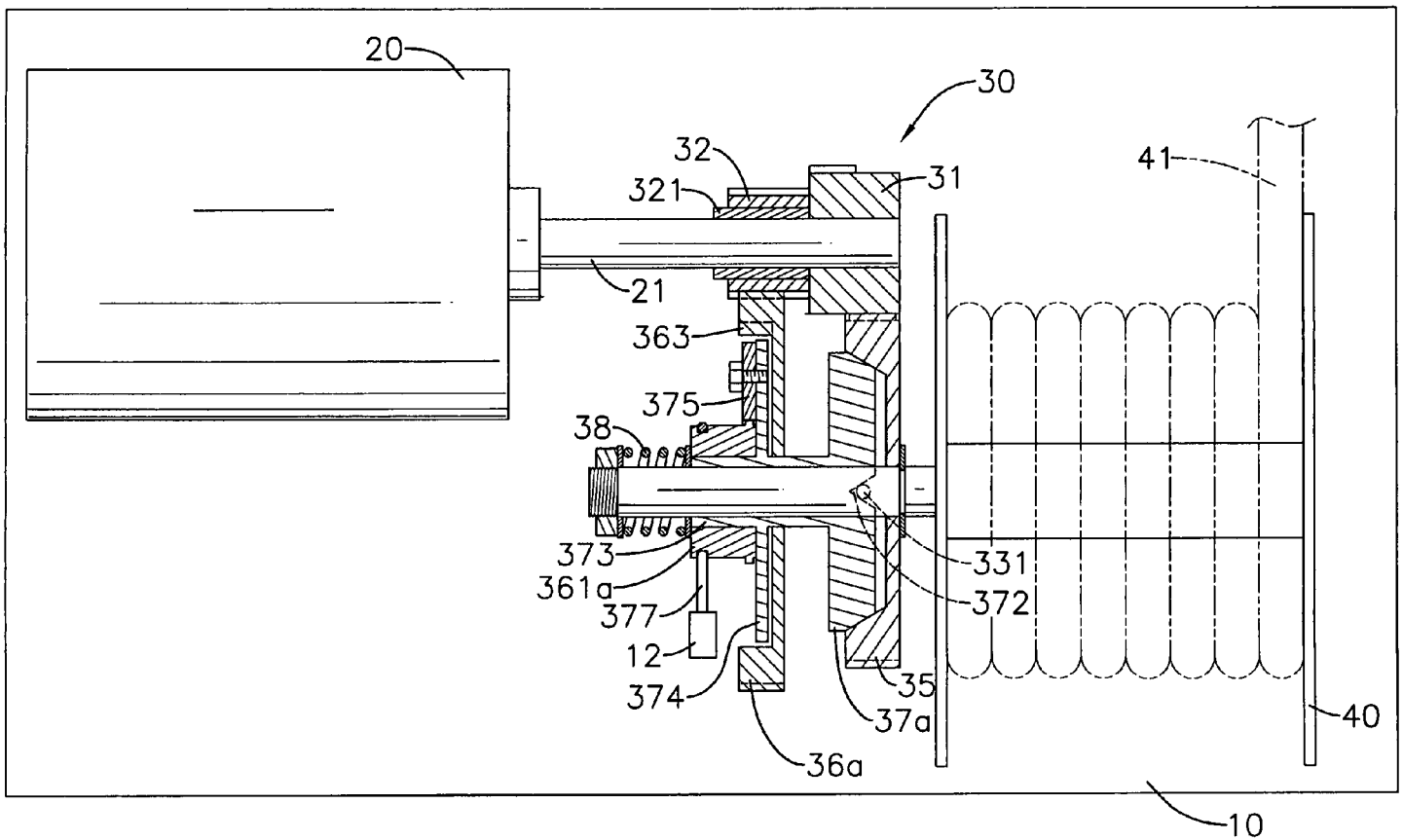
FIG. 3 is a top view in partial section of a second embodiment of the automatic winder in accordance with the present invention.

With reference to FIG. 3, a second embodiment of the automatic winder in accordance with the present invention has a base (10) further including a mounting bracket (12). The second one-way restrictor has a cylinder (361*a*), an annular flange (374), a projection (363) and a damping spring (377).

Figure 4:
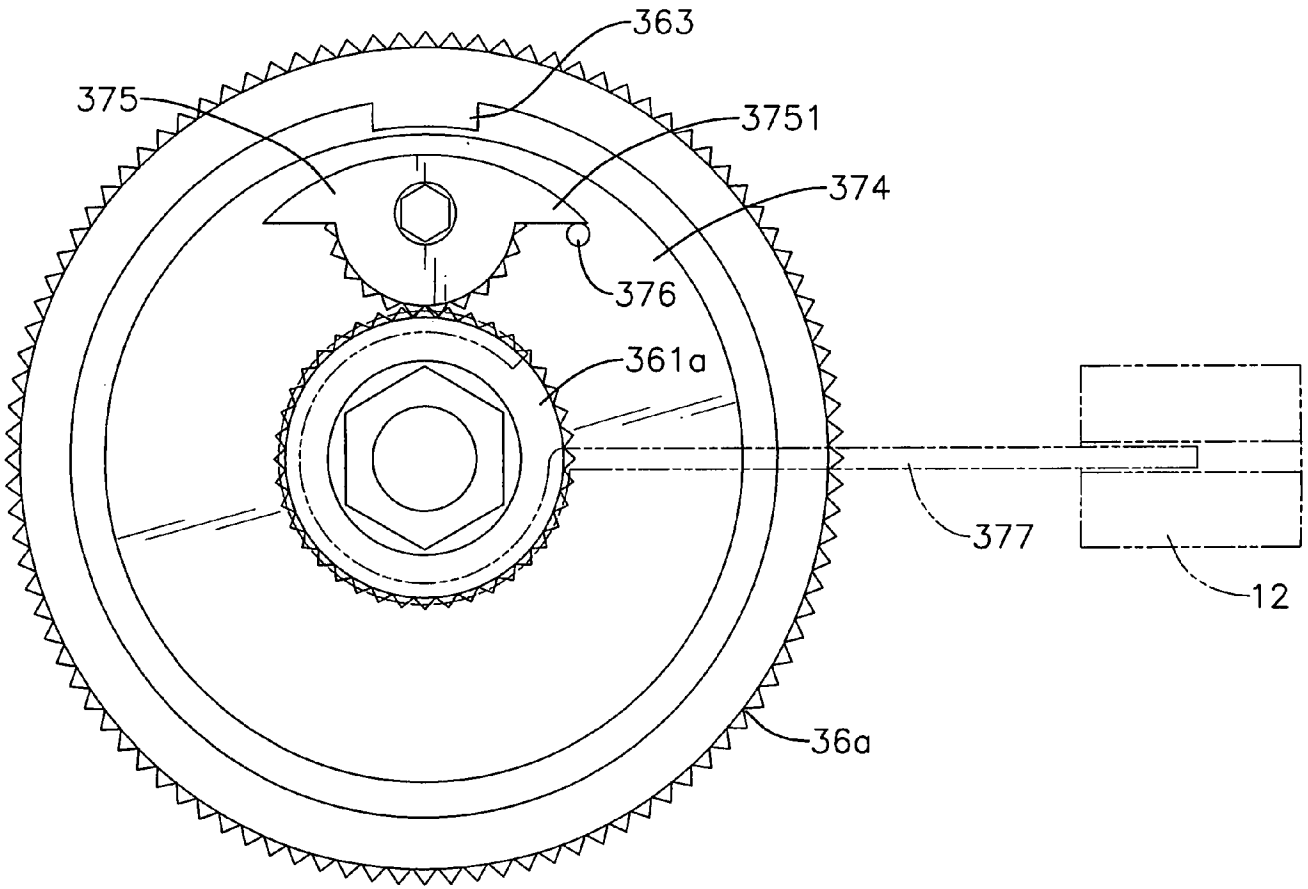
FIG. 4 is a rear view of the transmission device and the base of the automatic winder in FIG. 3.

With further reference to FIG. 4, the mounting bracket is mounted on the base (10).

The cylinder (361*a*) is annular, is mounted rotatably around the sleeve (373) on the clutch (37*a*) and has an outer edge and multiple keyways defined radially in the outer edge.

The annular flange (374) is formed on and extends radially out from the sleeve (373) and has a rear surface, a bolt (376) and a block (375). The bolt (376) is mounted on the rear surface of the annular flange (374). The block (375) is mounted rotatably on the annular flange (374) and has a first arm (3751) and a second arm and a semicircular wheel. The first arm (3751) and the second arm are formed on the block (375) and the first arm (3751) selectively abuts the bolt (376) to prevent the arm (375) from further pivoting. The semicircular wheel is formed on the block (375) and has multiple keys selectively engaging with the keyways in the cylinder (361*a*).

The projection (363) is formed on and extends radially inward from the inner edge of the low-speed driven gear (36*a*) and corresponds to the first arm (3751).

The damping spring (377) is mounted on the mounting bracket (12) and has a distal section. The distal section is curved and is mounted around the cylinder (361*a*) to damp a rotation of the cylinder (361*a*).

Figure 5:
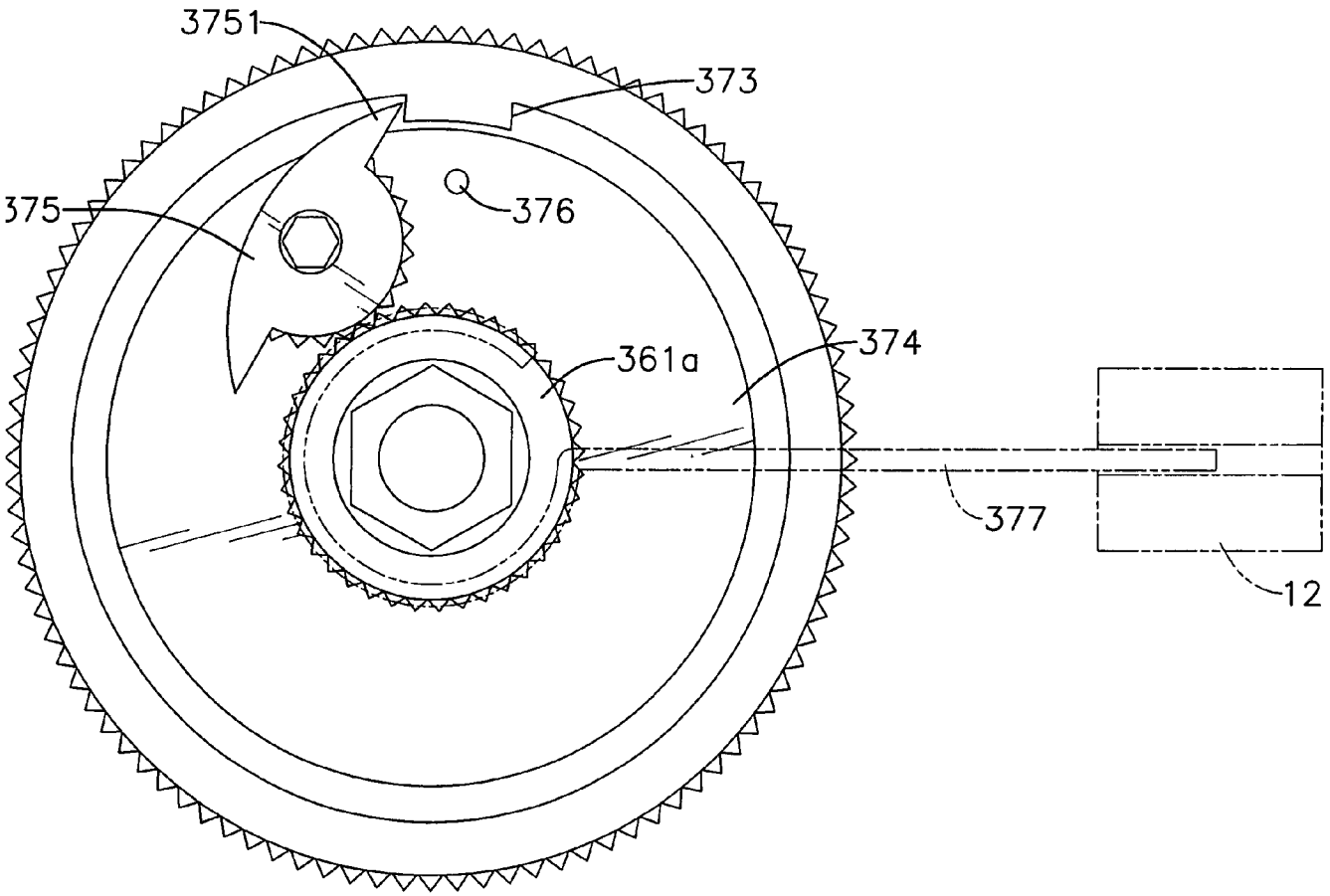
FIG. 5 is an operational rear view of the transmission and the base of the automatic winder in FIG. 4.

With further reference to FIG. 5, the clutch (37*a*) is capable of rotating on the cylinder (361*a*) when disengaging from the high-speed driven gear (35). Accordingly, the low-speed driven gear (36*a*) is driven by the motor (20) to rotate on the clutch (37*a*). Because of a friction between the low-speed driven gear (36*a*) and the clutch (37*a*), the rotating low-speed driven gear (36*a*) slightly drives the clutch (37*a*) to rotate relative to the cylinder (361*a*). At this time, the block (375) on the clutch (37*a*) is rotated around the cylinder (36*a*) due to the engagement of the keys on the block (375) and keyways in the cylinder (361*a*) and causes the first arm (3751) on the semicircular wheel to pivot outward and block the projection (363) on the low-speed driven gear (36*a*). Therefore, the low-speed driven gear (36*a*) and the clutch (37*a*), the transmission shaft (33) and the reel (40) rotates synchronously.

The clutch (37, 37*a*) slides out of and disengages from the high-speed driven gear (35) and causes the motor (20) to drive the reel (40) with the low-speed driving and driven gears (32, 36, 36*a*) when the motor (20) is overloaded. With the low-speed driving and driven gears (32, 36, 36*a*), the motor (60) keeps the motor shaft (21) rotating in a normal rotational speed extent despite the heavy article. Therefore, the motor (60) hardly breaks and is durable.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An automatic winder comprising:

a base having a support mounted on the base;

a motor mounted on the base and having a front end and a motor shaft mounted rotatably on the front end;

a transmission device connecting to the motor and having a high-speed driving gear mounted securely around the motor shaft;

a low-speed driving gear mounted around the motor shaft, being capable of rotating in a single rotational direction around the motor shaft;

a transmission shaft mounted rotatably through the support;

a high-speed driven gear mounted on rotatably around the transmission shaft, engaging with the high-speed driving gear and having a rear end;

a clutch mounted slidably around the transmission shaft, selectively engaging completely or halfway with the high-speed driven gear and having a front end selectively abutting the rear end of the high-speed driven gear tightly, a rear end and a sleeve formed on and extending from the rear end of the clutch and mounted around the transmission shaft;

a low-speed driven gear mounted around the sleeve on the clutch, being capable of rotating in a single rotational direction around the sleeve; and a spring mounted around the transmission shaft, located between and pressing against the support and the clutch and biasing the front end of the clutch to tightly abut the rear end of the high-speed driven gear; and a reel mounted securely around the transmission shaft and having spool of a cord, whereby the clutch separates from the high-speed driven gear and causes the high-speed driven gear to idle to make the motor drive the reel through the low-speed driving gear and the low-speed driven gear when the motor is overloaded.

2. The automatic winder as claimed in claim 1, wherein the low-speed driving gear has a central hole defined through the low-speed driving gear and through which the motor shaft extends and a first one-way restrictor mounted in the central hole, mounted around the motor shaft and keeping the low-speed driving gear to rotate in the single rotational direction;

the transmission shaft has a pin mounted on and extending radially out from the transmission shaft;

the clutch further has an outer edge, a central hole defined through the clutch and through which the transmission shaft extends, and a notch being V-shaped, defined in the front end of the clutch, communicating with the central hole and selectively engaging completely or halfway with the pin on the transmission shaft; and the low-speed driven gear has an outer edge, a central hole defined through the low-speed driven gear and through which the sleeve extends and a second one-way restrictor mounted in the central hole in the low-speed driven gear, mounted around the sleeve and keeping the low-speed driven gear to rotate in the single rotational direction.

3. The automatic winder as claimed in claim 2, wherein the first and second one-way restrictors are one-way bearings.

4. The automatic winder as claimed in claim 2, wherein a ratio of a rotational speed of the high-speed driven gear and a rotational speed of the high-speed driving gear is larger than a ratio of a rotational speed of the low-speed driven gear and a rotational speed of the low-speed driving gear.

* * * * *